US011703046B2

(12) United States Patent
Hoefel

(10) Patent No.: US 11,703,046 B2
(45) Date of Patent: Jul. 18, 2023

(54) PUMP SYSTEM WITH NEURAL NETWORK TO MANAGE BUCKLING OF A ROD STRING

(71) Applicant: Sensia LLC, Houston, TX (US)

(72) Inventor: Albert Hoefel, Houston, TX (US)

(73) Assignee: Sensia LLC, Houston, TX (US)

( * ) Notice: Subject to any disclaimer, the term of this patent is extended or adjusted under 35 U.S.C. 154(b) by 6 days.

(21) Appl. No.: 16/715,898

(22) Filed: Dec. 16, 2019

(65) Prior Publication Data

US 2020/0191136 A1 Jun. 18, 2020

Related U.S. Application Data

(60) Provisional application No. 62/780,282, filed on Dec. 16, 2018.

(51) Int. Cl.
*F04B 47/02* (2006.01)
*F04B 49/00* (2006.01)

(52) U.S. Cl.
CPC ..... *F04B 47/026* (2013.01); *F04B 49/00* (2013.01)

(58) Field of Classification Search
None
See application file for complete search history.

(56) References Cited

U.S. PATENT DOCUMENTS 3,343,409 A * 9/1967 Gibbs ..... F04B 49/02 73/152.61
5,828,003 A * 10/1998 Thomeer ..... E21B 17/20 138/123
6,609,428 B2 * 8/2003 Hull ..... G01N 3/32 73/789
9,347,288 B2 * 5/2016 Clemens ..... G06F 17/10
9,507,754 B2 * 11/2016 Fox ..... G06F 17/00
9,897,083 B2 * 2/2018 Pons ..... F04B 51/00
10,393,107 B2 * 8/2019 Jeong ..... F04B 49/065
2003/0065447 A1 4/2003 Bramlett et al.
2006/0271299 A1 * 11/2006 Ward ..... E21B 47/008 702/6
2013/0124166 A1 * 5/2013 Clemens ..... G06F 17/10 703/2
2013/0124176 A1 * 5/2013 Fox ..... G06F 17/00 703/7
2013/0151216 A1 6/2013 Palka et al.
2017/0016313 A1 * 1/2017 Pons ..... F04B 49/065
2020/0258250 A1 * 8/2020 Xiao ..... G06N 3/0454

FOREIGN PATENT DOCUMENTS

WO WO-2016/153895 A1 9/2016

OTHER PUBLICATIONS

Ordonez, B., et al., Improving the Operational Conditions for the Sucker-rod Pumping System, 18th IEEE Int'l Conference on Control Applications Part of 2009 IEEE Multi-conference on Systems and Control, Jul. 8-10, 2009, pp. 1259-1264.

(Continued)

*Primary Examiner* — Nathan C Zollinger
*Assistant Examiner* — Geoffrey S Lee
(74) *Attorney, Agent, or Firm* — Foley & Lardner LLP

(57) ABSTRACT

A method can include operating a pump system; determining a condition associated with the pump system; and controlling the pump system based at least in part on the condition.

13 Claims, 12 Drawing Sheets

(56) References Cited

OTHER PUBLICATIONS

PCT International Search Report and Written Opinion dated Apr. 6, 2020 for International Application No. PCT/US2019/066586.
Schlumberger. "Convention Pumping Unit" Retrieved from https://www.slb.com/~/media/Files/artificial_lift/product_sheets/rodlift/conventional-pumping-unit-ps.pdf. 2019. 2 pages.
International Preliminary Report on Patentability on PCT Appl. Ser. No. PCT/US2019/066586 dated Jul. 1, 2021 (9 pages).
CN Office Action with Search Report on CN Appl. Ser. No. 201980082683 dated Feb. 8, 2023 (16 pages).

* cited by examiner

PUMP SYSTEM WITH NEURAL NETWORK TO MANAGE BUCKLING OF A ROD STRING

CROSS-REFERENCE TO RELATED APPLICATION

This application claims the benefit of and priority to U.S. Provisional Patent Application No. 62/780,282, filed Dec. 16, 2018, which is incorporated herein by reference in its entirety.

BACKGROUND

Various types of equipment can be utilized in a subterranean environment. As an example, a pump system can be utilized to move fluid in a well in a subterranean environment.

SUMMARY

A method can include operating a pump system; determining a condition associated with the pump system; and controlling the pump system based at least in part on the condition. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a system may be a pump system that includes one or more mechanisms to reciprocate a rod string where the rod string can include rods that are joined via couplings. For example, a rod can include opposing threaded ends, which may be referred to as pins, where each of the ends can be threaded into mating threads of a coupling. In such an example, a long rod string can be assembled that is made up of a series of rods where the rods are joined by couplings. Such a rod string may be meters in length.

As an example, a rod may be a sucker rod. A sucker rod can be a steel rod that is used to make up a mechanical assembly between the surface and downhole components of a rod pumping system. As an example, a sucker rod may be a non-standardized length or a standardized length. As an example, a standardized length of a sucker rod may be in a range from about 25 ft to about 30 ft (e.g., about 7 m to about 9 m).

As an example, a pumping system can be an artificial-lift pumping system that can be powered using a surface power source to drive a downhole pump assembly. As an example, a pumping system can include a beam and crank assembly that creates reciprocating motion in a rod string that connects to the downhole pump assembly. In such an example, the downhole pump assembly can include a plunger and valve sub-assembly that can convert reciprocating motion to vertical fluid movement.

As an example, an electric motor may be utilized to reciprocate a rod string, optionally via one or more belt or chain drives. For example, a belt driven pumping unit can include a belt that is coupled to a rod string for reciprocating the rod string vertically within a well as the belt is driven by an electric motor. As an example, a pump may be a sucker rod pump that includes a sucker rod string.

Figure 1:
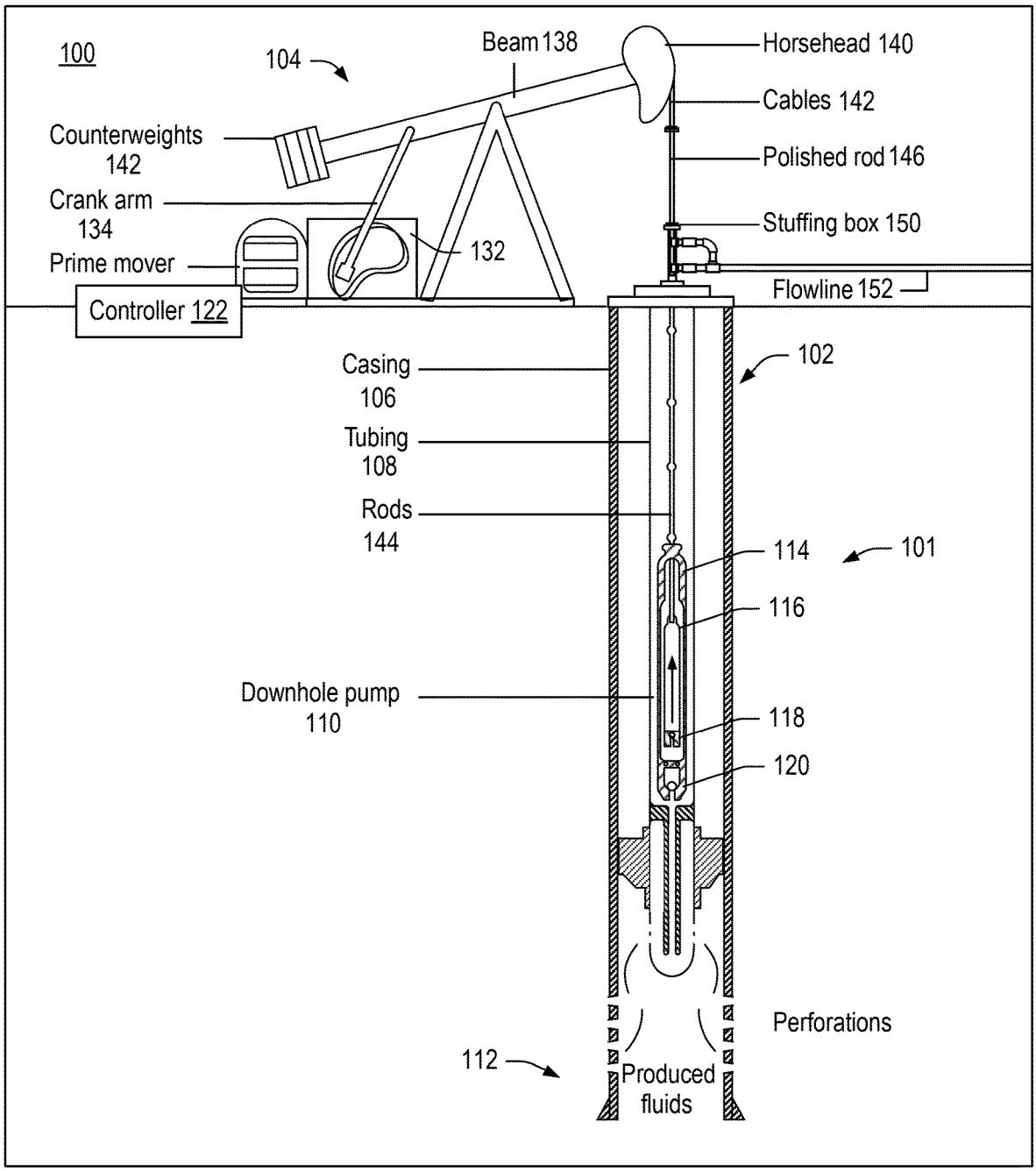
FIG. 1 illustrates an example of a system that includes a pump disposed in a subterranean environment.

FIG. 1 shows an example of a system 100 that includes a pump assembly 101 as driven by a pump drive system 104 that is operatively coupled to a controller 122. In the example of FIG. 1, the pump assembly 101 and drive system 104 are arranged as a beam pump. As shown in FIG. 1, a walking beam 138 reciprocates a rod string 144 that includes a polished rod portion 146 that can move in a bore of a stuffing box 150 of a well head assembly that includes a discharge port in fluid communication with a flowline 152. The rod string 144 can be suspended from the walking beam 138 via one or more cables 142 hung from a horse head 140 for actuating a downhole pump 110 of the pump assembly 101 where the downhole pump 110 is positioned in a well 102, for example, near a bottom 112 of the well 102.

A well in a subterranean environment may be a cased well or an open well or, for example, a partially cased well that can include an open well portion or portions. In the example of FIG. 1, the well 102 includes casing 106 that defines a cased bore where tubing 108 is disposed in the cased bore. As shown, an annular space can exist between an outer surface of the tubing 108 and an inner surface of the casing 106.

In the example of FIG. 1, the walking beam 138 is actuated by a pitman arm (or pitman arms), which is reciprocated by a crank arm (or crank arms) 134 driven by a prime mover 130 (e.g., electric motor, etc.). As shown, the prime mover 130 can be coupled to the crank arm 134 through a gear reduction mechanism, such as gears of a gearbox 132. As an example, the prime mover 130 can be a three-phase AC induction motor that can be controlled via circuitry of the controller 122, which may be connected to a power supply. The gearbox 132 of the pump drive system 104 can convert electric motor torque to a low speed, high torque output for driving the crank arm 134. The crank arm 134 can be operatively coupled to one or more counterweights 142 that serve to balance the rod string 144 and other equipment as suspended from the horse head 140 of the walking beam 138. A counterbalance may be provided by an air cylinder such as those found on air-balanced units.

The downhole pump 110 can be a reciprocating type pump that includes a plunger 116 attached to an end of the rod string 144 and a pump barrel 114, which may be attached to an end of the tubing 108 in the well 102. The plunger 116 can include a traveling valve 118 and a standing valve 120 positioned at or near a bottom of the pump barrel 114. During operation, for an up stroke where the rod string 144 translates upwardly, the traveling valve 118 can close and lift fluid (e.g., oil, water, etc.) above the plunger 116 to a top of the well 102 and the standing valve 120 can open to allow additional fluid from a reservoir to flow into the pump barrel 114. As to a down stroke where the rod string 144 translates downwardly, the traveling valve 118 can open and the standing valve 120 can close to prepare for a subsequent cycle. Operation of the downhole pump 110 may be controlled such that a fluid level is maintained in the pump barrel 114 where the fluid level can be sufficient to maintain the lower end of the rod string 144 in the fluid over its entire stroke.

As an example, the system 100 can include a beam pump system. As explained, a prime mover can rotate a crank arm, whose movement is converted to reciprocal movement through a beam. The beam can include counterweights or a compressed air cylinder to help reduce load on the beam pump system during the upstroke. The beam can be attached to a polished rod by cables hung from a horsehead at the end of the beam. The polished rod can pass through a stuffing box and be operatively coupled to the rod string. As explained, the rod string can be lifted and lowered within the production tubing of a cased well by the reciprocal movement of the beam, enabling the downhole pump to capture and lift formation fluid(s) in a direction toward surface (e.g., with a flow vector component against gravity) in the tubing and through a pumping tee that directs the fluid into a flowline.

As an example, the prime mover may be an internal combustion engine or an electric motor that provides power to the pumping unit. As an example, a prime mover can deliver highspeed, low-torque power to a gear reducer, which converts that energy into the low-speed, high-torque energy utilized by the surface pump. As shown in FIG. 1, a beam pumping unit, beam pump system or merely beam pump, converts the rotational motion of the prime mover into a reciprocating vertical motion that lifts and lowers a rod string connected to a subsurface pump.

Some aspects of a system can include prime mover type; pumping unit size, stroke length and speed setting; rod and tubing diameter; and downhole pump diameter, for example, based at least in part on reservoir fluid composition, wellbore fluid depth and reservoir productivity.

As an example, a design framework may facilitate some decisions as to design, for example, to arrive at a desired pump speed to attain production targets without overloading the system or overwhelming the formation's ability to deliver fluids to a wellbore.

Beam pumps may be constructed in a variety of sizes and configurations. Some systems include design aspects that can aim to better manage torque, rod wear and/or footprint. For example, as to some design aspects, consider locating counterweights on the crank arm or on the beam and use of compressed air rather than weight to assist in load balancing. Further examples can involve changes to crank, gear reducer and motor position relative to the beam, as well as alternative beam designs, where such factors may change system loading.

As an example, a system may place heavier rods, or sinker bars, in the lower section of the rod string to keep the rod string in tension, which reduces buckling and may help prevent contact with the tubing wall. Rod strings may also include stabilizer bars between sinker bars to centralize the rods, further reducing tubing wear.

Rod guides, which may be made of reinforced plastics, may be molded onto steel rods at depths where engineers may predict the rods will experience side loading due to a deviated wellbore path. The guides can act like bearings between the tubing wall and the rod to prevent rod and tubing wear. Sliding guides may be able to move between molded guides during the pump cycle, aiding production by scraping paraffin from the tubing wall, which helps prevent well plugging. A rod rotator or tubing rotator may be used to rotate the rod a small fraction of a revolution on each stroke of the pumping unit to further extend rod string life. As an example, slow rotation of rod guides may help scrape paraffin from the tubing wall.

Sucker rods may be connected to the surface pumping unit by a polished rod. A polished rod, for example, made of standard alloy steel and hard-surface spray metal coating, can support loads created during a pump cycle and help to ensure a seal through a stuffing box at a top of a well. The stuffing box can be attached to a wellhead or pumping tee and can form a low-pressure tight seal against a polished rod. The seal can form a barrier between a well and atmosphere and may allow flow to be diverted into a flowline, for example, via a pumping tee.

Figure 2:
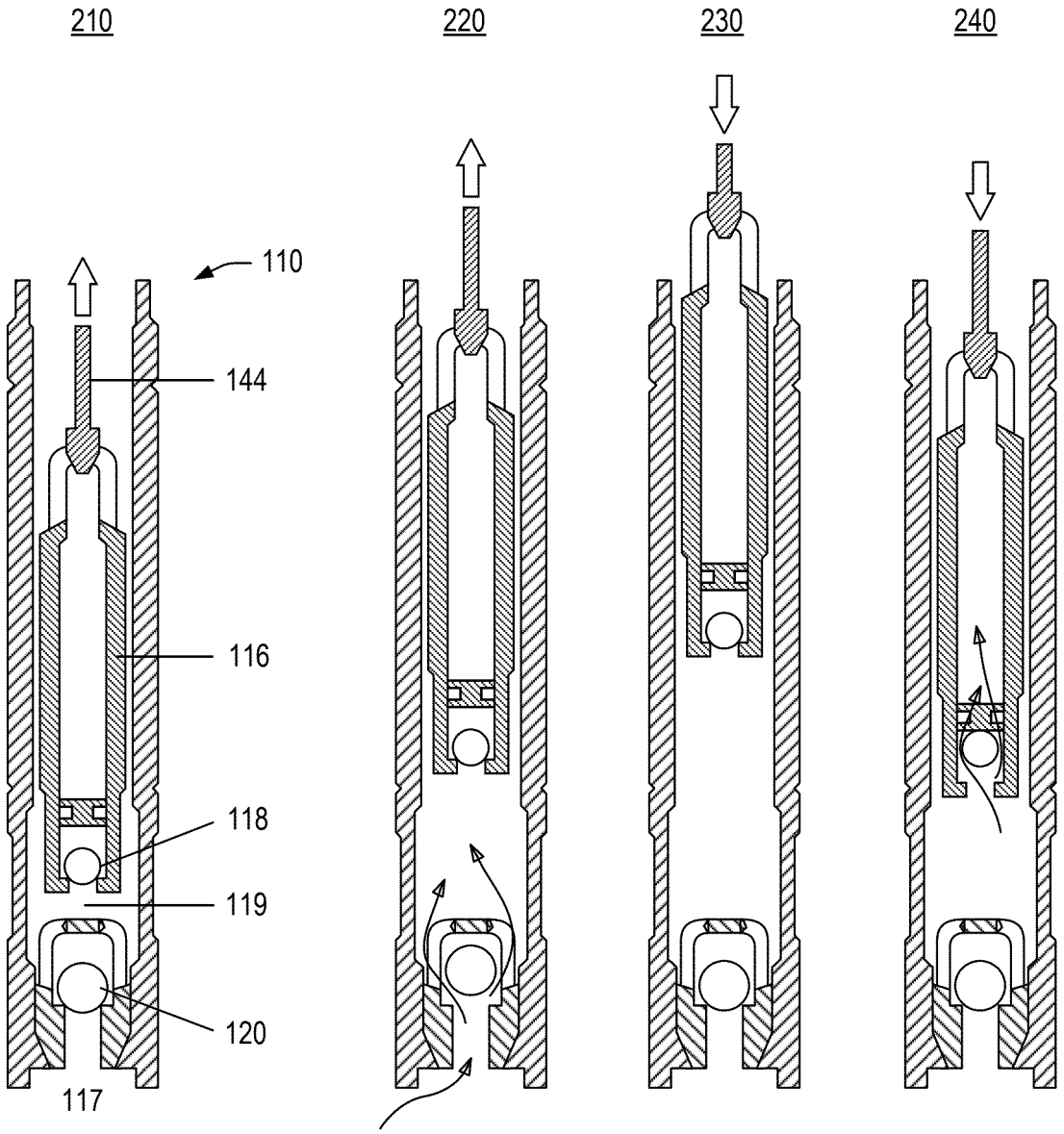
FIG. 2 illustrates an example of a method.

FIG. 2 shows cut-away view of the downhole pump 110, which shows a portion of a rod 144, the pump barrel 114, the plunger 116, the traveling valve 118, and the standing valve 120 positioned at or near the bottom of the pump barrel 114. Further shown in FIG. 2 are an opening 117 for inflow of fluid(s) and a chamber 119, which is shown to be in a space disposed at least in part between the traveling valve 118 and the standing valve 120. The downhole pump 110 is an example of a pump mechanism that can move fluid, where such fluid can differ with respect to time. As an example, fluid can be liquid and/or gas. As an example, fluid can include entrained solids, semi-solids, etc.

FIG. 2 shows an example of a method 200 with actions or states 210, 220, 230 and 240, which can be portions of a cycle (e.g., cycle actions, cycle states, etc.). As to the action 210, the pump 110 has achieved a maximum downward reach of a cycle. In the action 220, a beam can begin its upward movement such that the rod 144 and plunger 116 are pulled upwardly, forcing the ball of the traveling valve 118 to be on to its seat. This upward movement reduces the pressure in the pump chamber 119 until it is less than the pressure at the pump intake 117. The ball in the standing valve 120 can then come off its seat, allowing formation fluid to enter via the intake 117 and flow to the pump chamber 119. As to the action 230, the standing valve 120 is closed as the plunger 116 is at the end of the upward stroke. As to the action 240, as the plunger travels down, the pump chamber 119 experiences a pressure increase, pushing the ball in the traveling valve 118 off its seat. The action 240 allows the formation fluid to flow from the pump chamber 119 into the tubing via the plunger 116 as the plunger 116 continues to move downwardly in the pump 110. A cycle can include the actions 210, 220, 230 and 240. Such a cycle can be repeated thousands of times per day. The fluid displaced into the tubing may be carried toward surface on subsequent upward strokes of the plunger 116.

Figure 3:
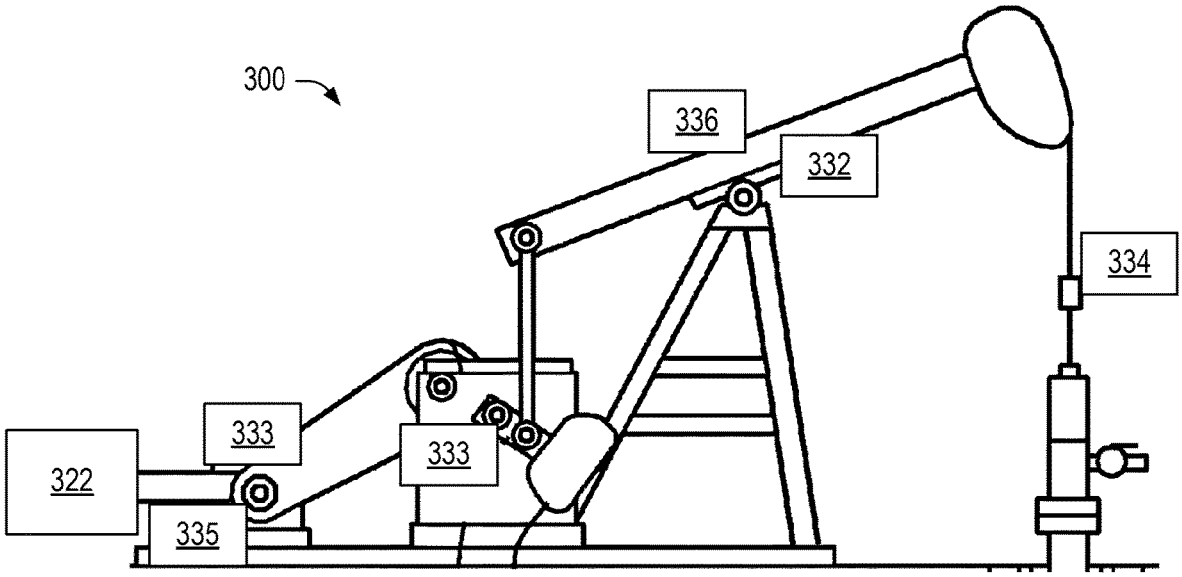
FIG. 3 illustrates an example of an instrumented pump system and examples of plots pertaining to operation of the pump system.
Figure 3:
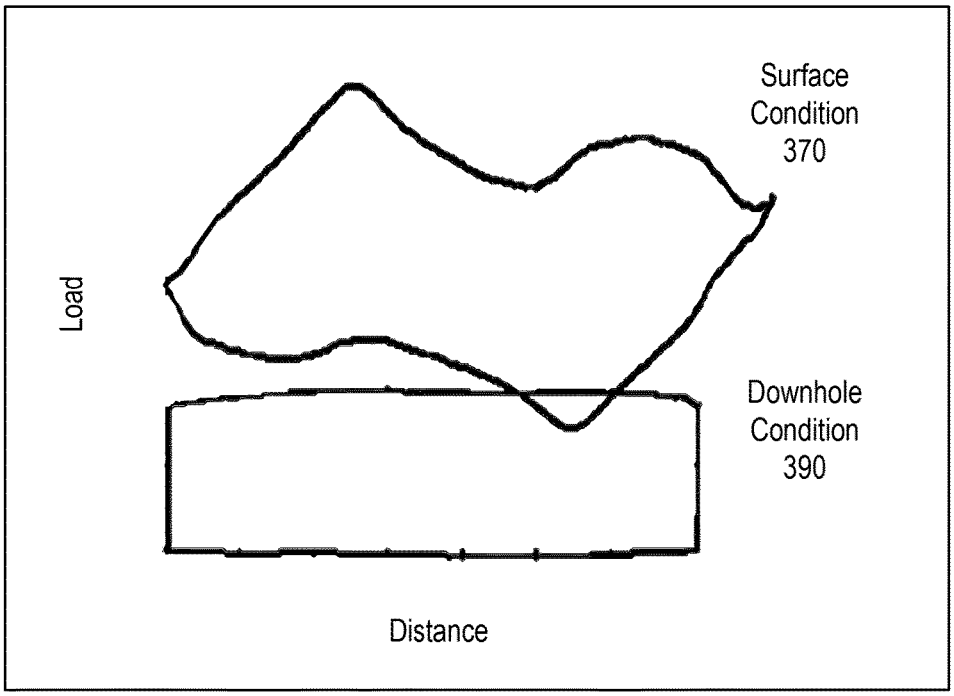

FIG. 3 shows an example of a system 300 with a controller 322 and various sensors that include position sensors and load sensors. For example, as to position sensors consider an inclinometer 332 and proximity switches 333 (e.g., Hall Effect sensors); and, for example, as to load sensors, consider a load cell 334, current sensors 335 and a beam transducer 336. Such sensors can be operatively coupled to the controller 322 (e.g., via wire and/or wirelessly through wireless circuitry). As an example, the load cell 334 can be a load-capable dynamometer attached to the polished rod for acquiring dynamic data, which may be transmitted and/or otherwise accessed by one or more pieces of equipment.

A controller can utilize sensor data to calculate rod loading (e.g., a surface condition) and, coupled with various models (e.g., algorithms), to estimate downhole pump fill (e.g., a downhole condition).

A frequent challenge to downhole pump operation is the entry of gas into the pump, leading to fluid pound or gas interference. Fluid pound occurs when the plunger travels down quickly through low-pressure gas and then suddenly hits liquid fluid; the resulting compressive shock can damage rod strings and the prime mover gearbox. Gas interference is less damaging and occurs when the plunger travels down through high-pressure gas. Both conditions can reduce system efficiency.

To combat gas interference, gas separators may be placed below the pump to redirect the gas into the wellbore annulus around the pump. Other modifications may be made to a completion to counter or reduce the effects of heavy oil and sand or other produced solids.

Operators can diagnose gas interference, liquid fluid pound severity and various other operating conditions using a dynamometer, which plots rod tension versus displacement measurements at the surface and downhole at the pump. The shape of an ideal downhole graph, called a dynamometer card, is rectangular and indicative of a full pump. Deviations from the ideal shape can indicate performance issues, such as gas interference, system leaks, stuck pumps, parted rods and various other anomalies that may be identified and accounted for automatically or through manual intervention.

Systems available for improving pump efficiency and protecting the pumping system include pumpoff controllers and variable speed drives (VSDs). When dynamometer values indicate gas interference, pumpoff controllers can be programmed to turn off the surface unit for a set period, calculated to allow enough time for fluid to migrate through the reservoir and into the wellbore. Such an approach tends to be less complex and less costly than using VSDs but tends to be limited as to effectiveness to areas where operators have sufficient production history to obtain accurate estimates of how long to shut down the unit. As an example, based on dynamometer measurements, a VSD may act to reduce the pump speed instead of turning the pump off. Such an approach allows time for the pump to become clear of gas or for liquid levels in the wellbore to rise without having to shut down. Use of VSDs may be particularly effective in very-low-permeability formations and shales, where the time required for oil to migrate into the induced fractures and into the wellbore can be difficult to predict even across a single field.

As rod pumping systems are relatively inexpensive to install and operate and have a relatively long life, rod pumping systems tend to be a quite common form of artificial lift. They tend to be "simple" machines that have a long and well-documented history in the industry and they tend to be adjustable to meet changing well or field conditions.

The use of rod pumps is likely to increase as the industry continues to expand its involvement in shale formations and other unconventional plays, which require operators to use high numbers of relatively low-flow-rate wells to exploit each field. Initial high pressures and high production volumes from these hydraulically fractured horizontal wells are quickly followed by low bottomhole pressures and steep production decline rates; production is possible through the use of artificial lift systems, of which rod pumps tend to be efficient at these low rates.

Even if not the initial artificial lift system of choice, rod pumping systems tend to be installed on many types of wells as production rates decline and the economics of initial systems are undone by higher operating costs. As a consequence, rod pumping systems are likely to maintain their position as a frequently deployed artificial lift technique.

A dynamometer is an instrument used in sucker-rod pumping to record the variation between the polished rod load and the polished rod displacement.

A dynamometer card is a record made by a dynamometer. An analysis of dynamometer measurements may reveal a defective pump, leaky tubing, inadequate balance of the pumping unit, a partially plugged mud anchor, gas locking of the pump or an undersized pumping unit. A dynamometer card may be in the form of a graph, such as a dynagraph.

FIG. 3 also shows a surface condition plot 370 and a downhole condition plot 390, which are plots of load versus distance with respect to time, for example, with respect to one or more cycles that include the actions 210, 220, 230 and 240 of FIG. 2.

As to the downhole condition plot 390, as mentioned, it can be based on a model. Such a model may include various types of factors such as, for example, velocity of sound in a rod, modulus of elasticity of the material of rods, length of a rod string, number of increments in position, number of discretization in time, pump velocity (e.g., cycles per minute, stroke per minute, etc.), rod stroke length, rod diameter, specific weight of rod material, a factor of dimensionless damping, specific gravity of fluid, diameter of tubing, etc.

As an example, the following equation may be utilized to model wave propagation:

$$\frac{\partial^2 u(s,t)}{\partial t^2} = v^2 \frac{\partial^2 u(s,t)}{\partial s^2} - c\frac{\partial u(s,t)}{\partial t}$$

The foregoing equation is a one-dimensional transient partial differential equation of a second order known as the one-dimensional wave equation with viscous friction. The solution returns the displacement of a point of a rod and time. The foregoing equation, without gravitational effects, is the so-called Gibbs equation. The first term in the above equation accounts for the newton acceleration force while the second term accounts for the spring force; noting that $v^2$ accounts for the propagation velocity as a function of Young's modulus and density $$\left(\left(\frac{E}{\rho}\right)^{0.5}\right),$$

and c is a damping term.

Friction and gravity terms may be added to the foregoing equation, for example, as follows:

$$-C(s)+g(s)$$

$$C(s)=\delta\mu(s)=\left[Q(s)+T(s)\frac{\partial u(s,t)}{\partial s}\right]$$

As an example, another approach can be utilized, which can include the following equations:

$$vx(xi,t)=vx(xi,ti-1)+(dt/dm)*Ftot_x(xi,t-1)/fc;$$

$$vz(xi,t)=vz(xi,t-1)+(dt/dm)*Ftot_z(xi,t-1)/fc$$

$$\text{omega}(xi,t)=\text{omega}(xi,t-1)+(dt/dI)*Mtot_y(xi,t-1)$$

vx: velocity in horizontal direction in global coordinate system vz: velocity in vertical direction in global coordinate system omega: angle velocity describing the bending in each defined segment t: discretized time xi: discretized position dt: time increment dm: mass per segment dI: bending moment Ftot_x: sum of internal and external forces in horizontal direction (spring force, bending force, solid friction)

Ftot_z: sum of internal and external forces in horizontal direction (spring force, bending force, solid friction, gravity)

Mtot_y: bending moment

In another embodiment a 3D model is used. Compared to the 2D model the 3D model allows to predict and/or observe helical buckling. For example, consider the 2D model being extended by the following terms:

$$vy(yi,t)=vy(xi,ti-1)+(dt/dm)*Ftot_x(yi,t-1)/fc;$$

$$\text{omega_}x(yi,t)=\text{omega}(yi,t-1)+(dt/dI)*Mtot_x(yi,t-1)$$

$$\text{omega_phi}(xi,t)=\text{omega_phi}(\text{Phi_}i,t-1)+(dt/dJ)*Mtorsiona_z(\text{Phi_}i,t-1)$$

Above, a damping adjustment factor (fc) is included, as well as a torsion term (Mtorsiona_z).

The coupled equations can be solved by coordinate transformation from an inertial coordinate system to the orientation of each discretized point into axial and normal directions. The partial differential equations are coupled through orientation vectors, which can be dynamically calculated for each position. For example, after coordinate transformation, partial differential equations are determined in axial and lateral direction and one that describes the change of bending angle between segments over time.

As an example, a three-dimensional system can be solved via recursive integration for velocity and solving again with integration over time to determine position in horizontal and vertical directions as well as bending angle.

As an example, friction force can be calculated from the normal force of each point and the friction coefficient of each point and points in the axial direction. The bending spring force is implicitly calculated from the change in orientation angle between two neighboring points. The angle wave velocity is calculated from the ratio of the moment of inertia of a cylinder segment to the bending stiffness of a cylindrical rod.

As an example, for a system model, the partial differential equations are solved in each domain in a recursive form by double numerical integration over time.

As mentioned, dynacard plots may be utilize in a system, a method, a controller, a model, etc. As an example, dynacards plots can estimate downhole force versus displacement. As an example, an approach can be to relate that to pump load force, particularly pressure. As an example, if the ratio of acceleration to the Earth's gravitational constant fluid acceleration term adds variation to the dynacard, that can increase the difficulty of dynacard classification and gas content estimation. As an example, an approach can include subtracting the acceleration force from the downhole force estimate such that the downhole dynacard becomes smoother and easier to relate to the pump force.

As an example, a load model may be utilized in a system, a method, a controller, a model, etc. For example, a load behavior of a pump can be for health pump behavior, which may cover a portion of a pump or a full pump, including high pressure gas or low pressure gas (e.g., fluid pound).

As an example, consider the following load model that covers these cases as described by isothermal compression.

Upstroke: vaxial<0(downhole speed in upwards direction)

$$Fn_up=\rho\ g\ h\ Ap+F_\text{friction_pump (Fluid weight)}$$

Downstroke: vaxial>0(downhole speed in downwards direction)

x>x0

$$Fn_dn=Ap\ (\rho\ g\ h\ (1-(xx-x0)/(xx-x))-F_\text{friction_pump}$$

(fluid weight pushing against compressed gas and pump friction)

else $$Fn_dn=-\rho\ g\ h\ Ar-F_\text{friction_pump (buoyancy and pump friction)}$$

As an example, where buckling can be a concern, a model can be multidimensional, which may be a 3D spatial model that includes one or more buckling terms. Rod buckling can be due to various causes, including, for example, fluid pound (e.g., pounding fluid). Rod buckling can also result from improperly sized and centralized sinker bars (e.g., above the pump to provide the additional weight). Sucker-rod buckling can cause excessive rod- and/or coupling-on-tubing wear above the pump. Buckling at the bottom of a rod string also may cause premature valve-rod or pull-tube failures. As mentioned, sinker bars can be utilized, which can help to reduce negative loadings and centralize a rodstring and tubing. For example, sinker bars can reduce negative loadings created by buckling of a rodstring during a pumping cycle while keeping the rodstring in tension. Sinker bars can be equipped with a strong pin to keep connections together during tough cyclic loads downhole. As an example, stabilizer bars and tubing centralizers can help to centralize certain portions of a rodstring and/or tubing and help to keep rod couplings off the tubing, thereby reducing tubing wear in susceptible areas.

Various equations may be utilized with various types of pumping equipment. As an example, consider one or more beam pumping units (e.g., sizes from API 25 to 1280, etc.). As an example, a pumping unit can be one or more types of pumping units described herein or another type of pumping unit such as, for example, a beam-balanced pumping unit, a TorqMax enhanced-geometry pumping unit, a FlexLift lowprofile pumping unit, a curved beam pumping unit, a HSU hydraulic stroking unit, a self-contained, portable, trailer-mounted pumping unit, etc.

As an example, a multi-dimensional spatial model can help to improve modeling of buckling, detection of buckling, control as to reduce risk of buckling and/or consequences of buckling, etc. As an example, a multi-dimensional model can include terms that provide for adjustment to acceleration, which can result in a more precise pump load model, which can allow for improved gas estimates and stroke length.

As an example, a system may include a 3D model, a pressure model and a load model. As an example, a system can provide for generation, recognition of and/or control of dynacard data. As an example, a system can include generating a specialized dynacard, for example, consider a dynacard with Newton inertial force estimates subtracted. As an example, a model can be composed of multiple models. For example, a model can be composed of a multi-dimensional model, a pressure model and a load model. As an example, a model can include one or more other models, which may be referred to as, for example, sub-models.

One or more of the foregoing equations may be implemented as a system of equations, for example, in a system that utilizes a combination of classification and system identification where the system of equations can represent a deviated well model with an advanced solid friction model. As an example, the system of equations may be referred to as a system model or a reference model.

As mentioned, downhole condition can be better understood through use of a model. Where downhole condition is understood to at least some extent, control may be more effective, which may aim to reduce wear, increase efficiency, etc.

As an example, a method can use a wave propagation solution to provide a starting point for a load model for a simulation. For example, consider a set of initial conditions given by output of a computational solver for a wave propagation model for solving a load model via a computational solver. As to some differences, a wave propagation model can include inputs of surface force and position and output as a pump model; whereas, a system model can include inputs of surface force and pump model and outputs of position and force at various locations; or inputs of position and pump model and outputs of position and force at various locations.

In one embodiment the system model can be based on a 2D model, where an equivalent horizontal curvature is projected in one axis. In such an example, the bending forces may be accounted for, although this can contribute to a small gravity error. As mentioned, system dynamics can be described by three coupled partial differential equations that can be solved by double numeric integration in a discrete domain. In such an example, coupling can be related to the normal and lateral forces that are derived from the dynamic well orientation in each defined segment.

Figure 4:
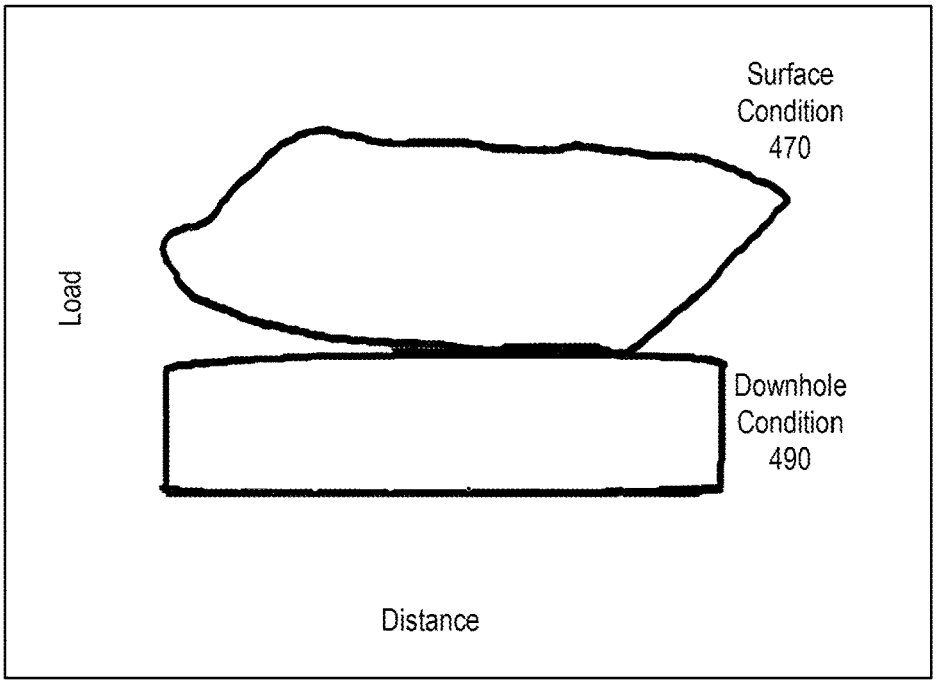
FIG. 4 illustrates examples of plots pertaining to operation of a pump system.
Figure 4:
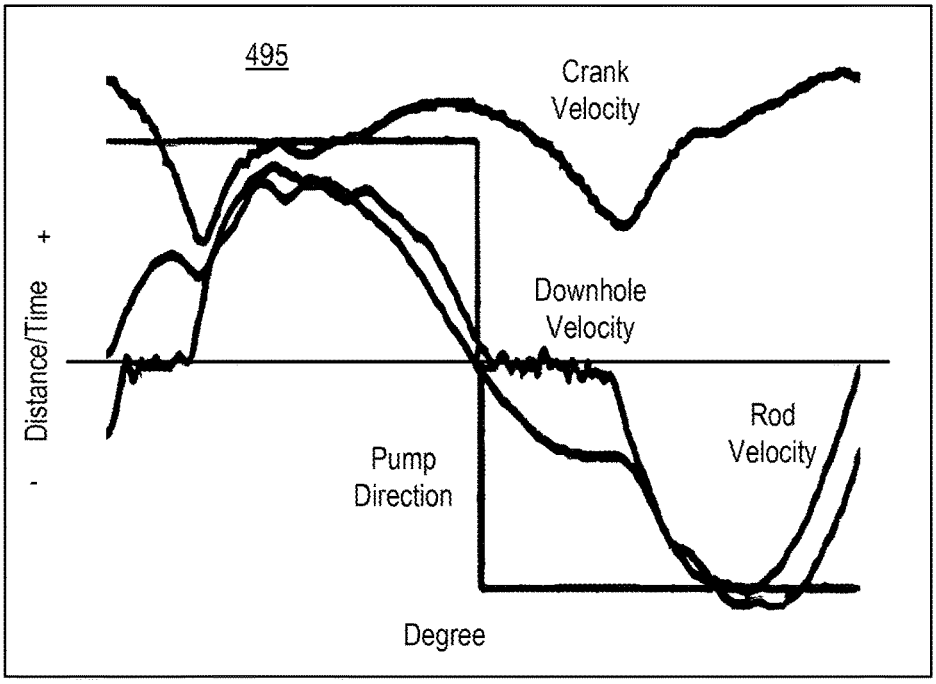

FIG. 4 shows a plot of surface condition 470 and downhole condition 490 with control, where, in comparison to the plot of FIG. 3, is shown to reduce load extrema of the surface. FIG. 4 also shows a plot 495 that includes pump direction, crank velocity, rod velocity and downhole velocity as distance with respect to time (velocity) versus degree from 0 degrees to 360 degrees, which represents a single cycle.

Figure 5:
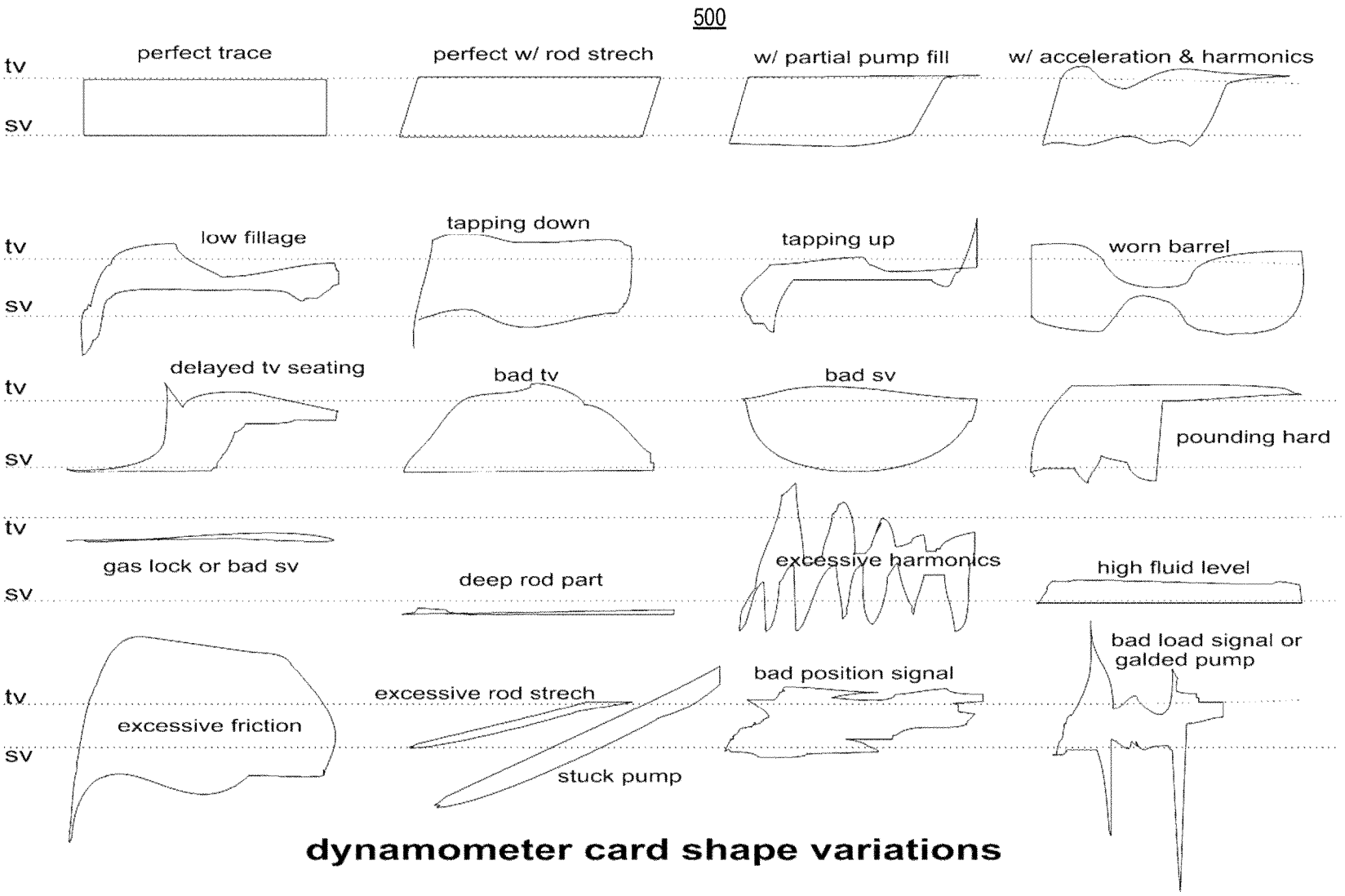
FIG. 5 illustrates examples of plots pertaining to operation of a pump system.

FIG. 5 shows some examples 500 of dynamometer card shape variations, which may facilitate control. The shapes correspond to dynamic conditions such as a perfect trace, rod stretch, partial pump fill, acceleration and harmonics, low filage, tapping down, tapping up, worn barrel, delayed tv sensing, bad tv, bad sv, pounding hard, gas lock or bad sv, deep rod part, excessive harmonics, high fluid level, excessive friction, excessive rod stretch, stuck pump, bad position signal, bad load signal or galded pump, etc.

Figure 6:
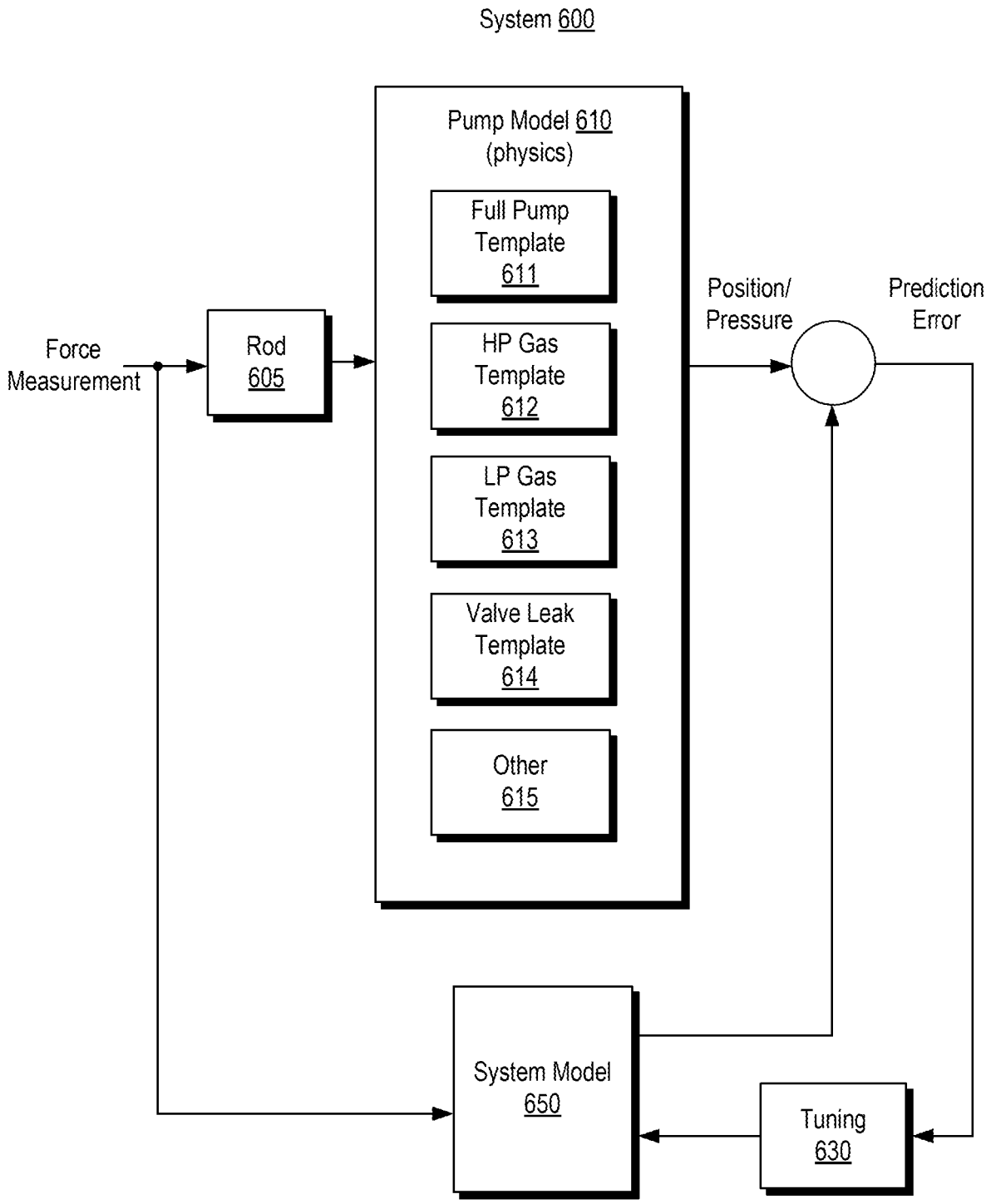
FIG. 6 illustrates an example of a system.

FIG. 6 shows an example of a system 600 that includes a rod 605, a pump model block 610 (e.g., actual physics), a tuning block 630 and a system model block 650. In the example of FIG. 6, a measurement such as a force measurement represents force applied to the rod 605, which is an input to the pump model block 610 and to the system model block 650. As shown, the blocks 610 and 650 can provide outputs such as position and/or pressure. Where those outputs differ between the blocks 610 and 650, a prediction error can be determined, which can be input to the tuning block 630 that can interact with the system model block 650 for tuning of the system model. Such tuning aims to improve the ability of the system model block 650 to model the actual physical system.

As shown, the pump model block 610 can include various sub-blocks such as a full pump template 611, a high pressure gas template 612, a low pressure gas template 613, a valve leak template 614 and one or more other templates 615, etc.

The system 600 allows for rod pump monitoring and system identification through the system model of the system model block 650. The system model can be or include, for example, the aforementioned three coupled partial differential equations.

While sucker rod pumps are mentioned, one or more types of artificial lift technologies (e.g., KUDU hydraulic pumps, etc.) may be modeled in a system such as the system 600. As to sucker rod pumps, such pumps can include a series of rods that form a unified rod that has a length of at least approximately 30 feet (e.g., approximately 10 meters). As an example, a pump may be implemented in the water industry, the waste industry, a general processing/manufacturing plant, etc. The system 600 can provide for condition monitoring of pump equipment.

The system 600 can implement an approach involving parameter estimation, observers and system identification to monitor the operation of a rod pump. The information of interest relates to pump efficiency, pump speed, gas content, integrity of pump, integrity of the rods, rod guides, tubing and casing.

As mentioned, pump technology can utilize surface measurements of force and position. These measurements can be used to calculate via a wave propagation model an estimate for downhole force and position over time. The results can then be used to plot the force versus position of the downhole plunger position (see, e.g., plots of FIGS. 3, 4 and 5). A so-called downhole dynacard (e.g., dynamometer card) can be taken as a basis to assess a pump system and pump performance. As mentioned, a simplistic approach uses knowledge of the geometry and material properties, but makes no assumption about the physics of the pump operation.

The system 600 can utilize parameter and observer techniques from control theory. For example, a system can include an input that stimulates the system and an output that can be measured. Parallel to the running physical system (see, e.g., the pump model block 610), a reference model with an equivalent mathematical structure (see, e.g., the system model block 650) can be running that receives the same stimulus as the physical system.

In the example system 600 of FIG. 6, the system model can be based on corresponding physics that describe dynamic dependencies between input and output. For a physical installation, the mathematical structure can be parametrized, while allowing for some variation for at least some of the parameters and states with higher uncertainty. The result of reference model is a prediction of the measurement output (e.g., position, pressure, etc.). In the example system 600, a goal of the reference model can be to find system states and fine tune system parameters, such that the measurement prediction and the real measurement become consistent (e.g., prediction error converges to zero). Provided that the dependency between parameters and prediction error is unique, the best parameter and system estimate may be reached when the prediction error reaches a minimum deviation.

As explained, a basic rod pump installation includes a downhole displacement pump that includes two valves, a traveling valve in the plunger and a standing valve on the bottom. It is coupled through a rod assembly from downhole to surface to an actuator that provides the moving force. In hydraulic pumps, this actuator is implemented hydraulically, in sucker rod pumps it is driven through a mechanical assembly from a motor.

On the upward motion the standing valve at the bottom is open and fluid is sucked in to the bottom side of the below the piston. While the fluid on top of the piston is lifted up. On the downstroke the traveling valve opens and the standing valve is closed, which allows the barrel on top of the piston to refill with fluid.

As an example, the system 600 can be utilized for rod pump automation and diagnostics software, possibly implemented in SCB2020, an RTU or on the cloud. As mentioned, the system 600 may be utilized for instrumented sucker rod pumps and/or hydraulic pumps.

The system 600 may be integrated into one or more well site automation products in the field, integrated cloud products (for instance reservoir monitoring, modeling, validation, planning, optimization, etc.), also statistical data analytics for process and design improvements.

Figure 7:
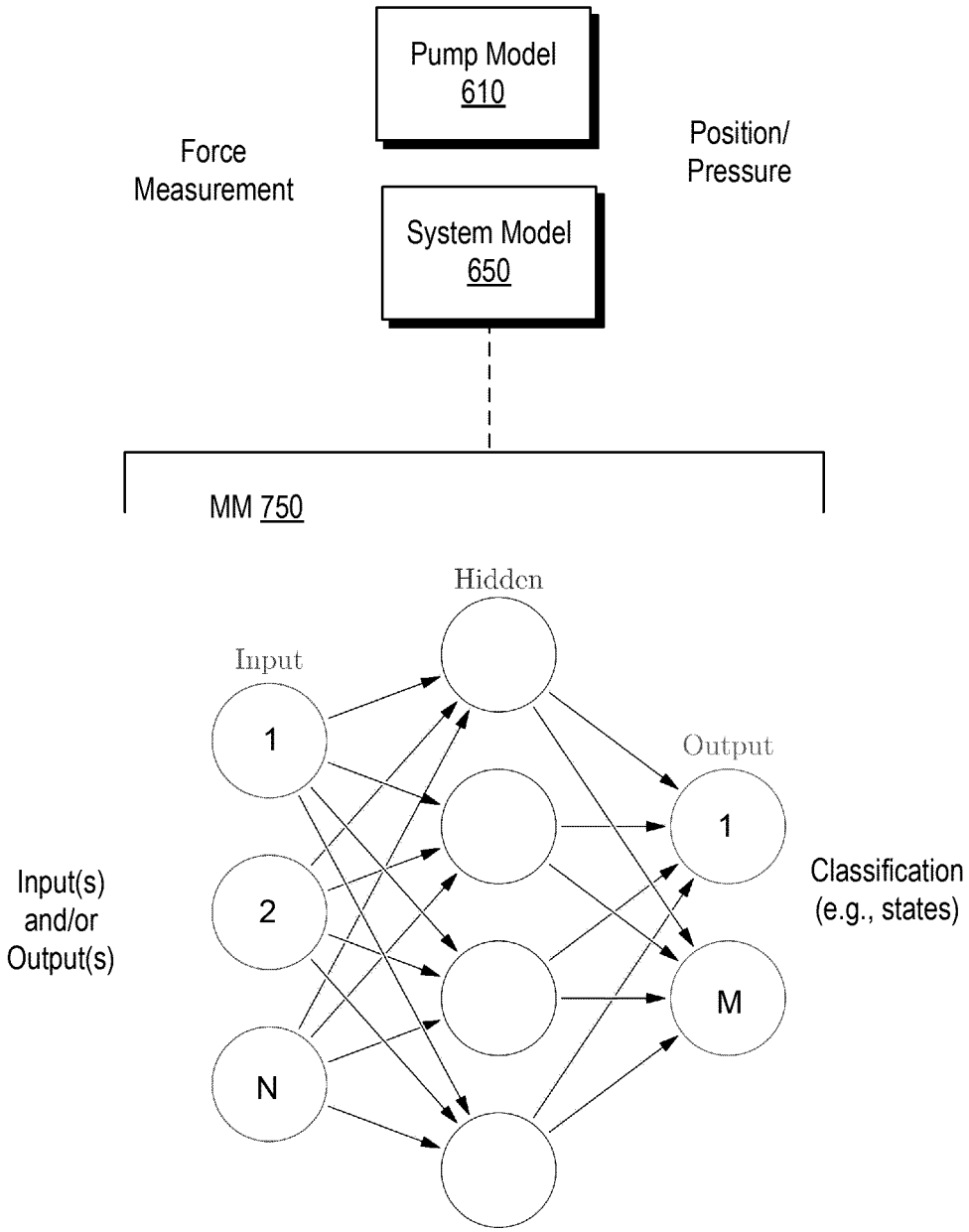
FIG. 7 illustrates an example of a machine model.

FIG. 7 shows an example of the pump model block 610, the system model block 650 and a machine model 750, which may be utilized in combination with the blocks 610 and 650 and their input(s) and/or output(s), for example, for purposes of classification, prediction, etc. For example, the machine model 750 can include one or more inputs and one or more outputs where nodes can be "hidden" as in a neural network model. The machine model 750 can be trained using training data, which can adjust weights, etc., as may be associated with the nodes. A trained machine model can be utilized for purposes of classification. For example, given a particular input to the machine model 750, as a trained machine model, it may classify a pump system as being in a particular state. As to examples of states (e.g., dynamic cyclical states), consider one or more of the examples 500 of FIG. 5.

As an example, training data may be generated using a physics-based model of a pump system. For example, the aforementioned coupled system of partial differential equations may be utilized to simulate operation of a pump system and optionally associated well parameters, fluid parameters, etc. Such data may include inputs and outputs that can be utilized to train a machine model such as a neural network model. As an example, one or more features of the TENSOR FLOW framework may be utilized for purposes of machine modeling (Google, Mountain View, Calif.). As an example, training may be in real-time, parallel to simulation. In such an example, as training data are generated, machine learning can proceed. As an example, training data may be generated in advance of machine learning. For example, consider generating a database of states from a physics-based model where various states can be selected for use as training states for training a machine model to generated a trained machine model for a particular type of pump, type of well, type of fluid, etc.

As an example, output of a machine model (e.g., a trained machine model) can be utilized to adjust a physics-based model or a pump system. For example, consider identification of a state via classification where the state is characterized by one or more physical parameter values that can be utilized to adjust the physics-based model.

As an example, the machine model 750 may be utilized to determine one or more aspects of a well. For example, for a deviated well, the machine model 750 may output a state that is a well state that physically describes deviation of a well. As an example, the machine model 750 can include classifying one or more types of fluids, optionally with respect to one or more well parameters (e.g., well depth, etc.).

As an example, a system can use a machine leaning approach based on regression with a predetermined mathematical structure based on physics (see, e.g., coupled partial differential equations). In artificial intelligence (AI) terminology, an approach can be or include a true model-based approach, rather than merely a crude data driven model approach. As an example, a combination of classification with fine tuning of a wave propagation model through system identification can be implemented for one or more purposes.

As an example, one or more kernel techniques may be utilized for purposes of learning. In machine learning, kernel methods are a class of algorithms for pattern analysis, which include the support vector machine (SVM). A general task of pattern analysis is to find and study general types of relations (e.g., clusters, rankings, principal components, correlations, classifications) in datasets, which can be datasets such as in FIG. 5. As an example, in various machine learning approaches, data can be transformed into feature vector representations via a feature map. In kernel approaches, a specified kernel may be utilized (e.g., a similarity function over pairs of data points in raw representation).

A kernel technique can utilize one or more kernel functions, which enable them to operate in a high-dimensional, implicit feature space without computing coordinates of data in that space; rather, involving computing the inner products between the "images" of pairs of data in the feature space. Such an operation can be often computationally more efficient than the explicit computation of the coordinates. As an example, a kernel functions can be for one or more of sequence data, graphs, text, images, vectors, etc.

As an example, a system can include one or more features for pattern recognition and/or pattern analysis. As an example, a control system may aim to generate a particular type of pattern (e.g., a dynacard pattern, etc.). As an example, a control system can include a desired target pattern (e.g., with appropriate characteristics) and can issue control instructions (e.g., commands, etc.) to a pump system that aims to achieve the desired target pattern. In such an approach, one or more types of errors may be determined via a comparison of one or more patterns. For example, an actual pattern may be compared to a plurality of predetermined patterns (e.g., optionally specialized for a particular installation, etc.) to identify operational conditions that can be amenable to control to achieve a desired, target pattern (e.g., or to more closely approach the desired, target pattern). As mentioned, a system can include one or more models, which can be trained machine models or other models. Such a system may receive data during a pumping operation and utilize such one or more models to determine an appropriate control action or actions and then issue one or more instructions to a pump system to control the pumping operation. As mentioned, such a system may operate in part via a physics-based model, which may be utilized, for example, for generating patterns that may, in turn, be utilized for purposes of model training to generate a trained model that can be implemented for control, optionally alone or in combination with one or more physics-based models. As an example, one or more plots may be pixelated to be turned into images (e.g., 2D pixel images, etc.) for purposes of training, pattern recognition, error determinations, control, etc.

The approach of FIG. 7 can improve accuracy of a wave propagation model, particularly in one or more deviated wells. Such an approach can improve accuracy of predicted rod lifetime, accuracy of stroke length, etc.

As mentioned, the system 600 can use mathematical structures based on physics of pumping and a comprehensive system model for system identification and monitoring.

Referring again to the system 600, it can operate as a dynacard estimator. As an example, the system model can be based at least in part on the classical structure of the Gibbs equation in discrete form with an additional term for solid friction. While Gibbs mentions one form of a friction model, one or more Coulomb friction models may be implemented.

In a classical approach, position and force measurement at surface are treated as an input. In contrast, in the system 600, force can be utilized as an input and position can be an output. The physical system including rod, tubing, rod guides, well deviation and pump can be part of a dynamic system that is stimulated with a force at surface and that responds with a change in position at surface. Downhole force and position and downhole pump operation can be calculated implicitly as a byproduct of the system model.

To get the best estimate of the system, tuning can be implemented for one or more system parameters and state variables of the reference model of the system, for example, to minimize prediction error between measured and predicted position at surface.

As an example, a system model can be complemented with one or more other measurements as may be available, such as surface pressure in the tubing and casing. By monitoring the system state over time, degrading performance can be detected. In response, one or more control signals may be issued to control one or more parameters of a physical pump system.

A comprehensive system model can have a valuable effect on simulation. Simulation results for surface and downhole state can be used to generate a large variety of different configuration examples that can be used, for example, for machine learning. A physics-based model can give a good reference of truly expected downhole and surface dynacards that can be used as a reference for the true observations at the well.

Standard dynacard shapes (e.g., patterns) as may be shown in FIG. 5 may be, to some extent, considered idealized as real acquired dynacards can vary substantially. Noise reduction through low pass filtering or a reduced number of the Fourier decomposition in the Gibbs method have a low pass filter effect that reduces the sharpness of edges and corners. If the wave propagation is calculated with higher dynamics, that can result in dynacards that have a lot more high spatial frequency contents. Part of them may be attributed to noise, some of the ripple of force versus range can be attributed to a true system variation that is impacted by the reflective waves along the pump.

As an example, signal content in these higher spatial frequencies can be used as an additional independent measurement output, since its contents affect the dynamic component of solid friction in deviated wells.

As an example, a method can provide for better design validation during commissioning. As an example, a method can provide for better diagnostics of rod, rod guide and tubing wear. As an example, a method can provide for lifetime prediction. As an example, a method can provide for failure and wear detection.

As an example, a method can get a better estimate of a system, such as estimates as to one or more of damping, friction, pump fill factor, pump failure type, rod/rod guide wear, etc. Such estimates may be utilized for purposes of control.

As an example, a method can help to reduce noise impact. As an example, a method can create an extensive and comprehensive database for reference examples for machine learning. As an example, a method can include training one or more machine models to generate one or more trained machine models. Such trained machine models may be utilized for one or more purposes, which can include classification (e.g., state identification). As an example, a controller may operate on classification as output by a trained machine model.

As to various aspects of an environment, as mentioned, a well may be deviated. For example, a well can include a portion that is deviated from vertical. In such an example, gravity, friction, fluid flow, etc., can differ from that of a vertical well. As to fluid or fluids (e.g., and/or pressure, temperature, etc.), consider chemical environments that can be detrimental to pump system equipment and/or operation.

Figure 8:
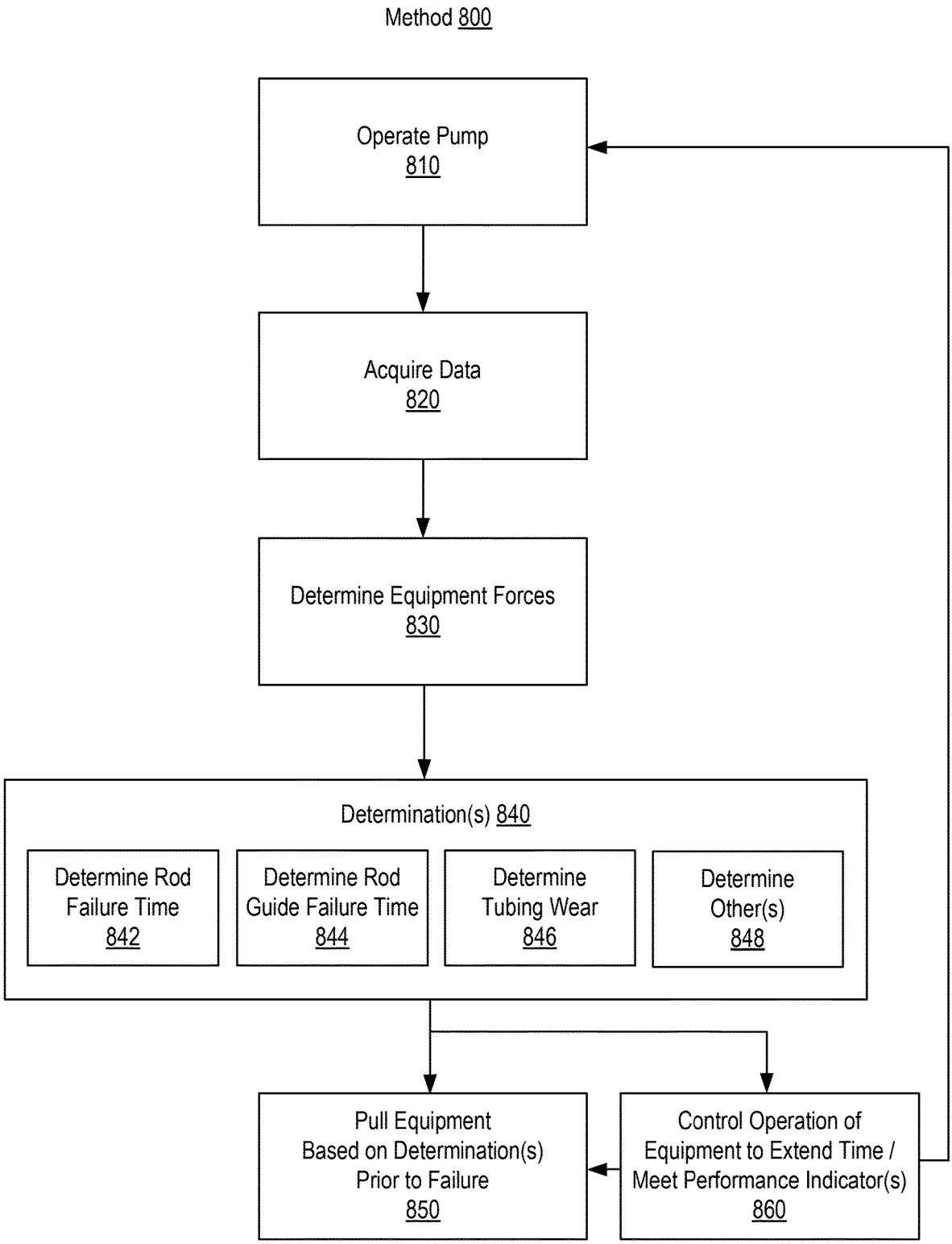
FIG. 8 illustrates an example of a method.

FIG. 8 shows an example of a method 800 that includes an operation block 810 for operating a pump, an acquisition block 820 for acquiring data via one or more sensors during operation of the pump, a determination block 830 for determining forces associated with operation of the pump, a determination block 840 for making one or more determinations as to operation of the pump, a pull block 850 for pulling equipment based on one or more of the determinations prior to failure and a control block 860 for controlling operation of the pump to extend time (e.g., lifetime) and/or to meet one or more performance indicators (e.g., PIs). As shown, the method 800 can be a control loop, for example, where the block 860 can continue to the block 810. Such a control loop may proceed until a decision is made to enter the pull block 850 to pull equipment.

As shown in the example of FIG. 8, the block 840 includes a determination block 842 for determining a rod failure time for one or more rods of a sucker-rod pump, a determination block 844 for determining a rod guide failure time for one or more rod guides, a determination block 846 for determining a tubing wear condition where a guide may become worn such that a rod or other component is causing tubing wear, and a determination block 848 for making one or more other determinations.

As mentioned, a method can include determining one or more normal forces, which can be normal to a longitudinal axis of a component of a pump such as a rod of a pump. As an example, a control system can include circuitry that can determine one or more normal forces, which can be normal to a longitudinal axis of a component of a pump such as a rod of a pump. As mentioned, a normal force can act to cause or increase friction, which may occur in a time dependent manner. Such friction can cause wear, which may lead to failure of a component or components. For example, consider determining a normal force, which can include determining a normal deviation from an axis, and determining that a component contacts another component with the normal force, which may be due to the normal deviation from an axis (e.g., radial deviation from a longitudinal axis). Such an assessment may be performed with respect to time to determine wear based on material properties, contact, motion, momentum, velocity, hysteresis (e.g., directional effects), etc.

As an example, consider a sucker rod centralizer (SRC) that aims to reduce rod coupling wear where the SRC can include a nonrotating sleeve design that is tapered for rod tripping. Such a SRC can reduce torque in deviated wells and lower workover frequency by reducing rotational rubbing and rod wear. SRCs may be included in vertical well installations, for example, to reduce transmission of eccentric motion of a rotor to a rodstring wobble in the rodstring to the polished rod.

As an example, an installation can include at least five nonrotating SRCs in a vertical well to reduce eccentric motion of a rotor from being transmitted to the rodstring. As an example, an installation can include one SRC at about 3.7 m above the rotor head and one SRC on top of each of the two full sucker rods. As an example, an installation of SRCs can help to reduce wobble in the rodstring from being transmitted to the polished rod, which can help to reduce the life of the seal or stuffing box. As an example, consider SRCs placements at the bottom of the polished rod and at the bottom of the adjacent sucker rod. As an example, an SRC can include a spindle made or 4140 hardened, tempered, stress-relieved tool steel and can include chromed rod couplings and a KEVLAR-NYLON copolymer sleeve. As an example, consider tubing sizes in a range from about 70 mm to about 120 mm and sucker rod sizes in a range from about 20 mm to about 30 mm.

As to control of a sucker rod pump, a controller may be a variable frequency controller, which may be referred to as a drive (e.g., a variable frequency drive). Such a controller can include circuitry that provides for motor speed and torque accuracy, low harmonics, and smooth speed ramping. As an example, such a controller may be operated according to a method such as the method 800 of FIG. 8 where smoothness can be controlled based at least in part on one or more of the determinations of the determination block 840 (e.g., and/or the block 830). As an example, a controller may operate according to the system 600. For example, a controller can include a system such as the system 600 where a pump model and a system model are utilized in a loop or loops that can provide for prediction error being fed back to the system model for tuning. As an example, a controller can include circuitry that can operate using one or more of the equations presented above. For example, a controller can operate using equations that account for normal force that is normal to a longitudinal axis of one or more components of an installation (e.g., sucker rod pump components, SRCs, tubing, etc.).

Referring again to the pull block 860 of FIG. 8, a method can include performing a post-pull assessment. Such a method can include feeding information from a post-pull assessment to a tuning block that can tune a system model or other model. As an example, such tuning can provide for more accurately determining force and/or failure (e.g., wear, etc.). As an example, consider pulling sucker rods where sucker rods are examined for wear, which can be noted with respect to normal direction, which may be azimuthally in 360 degrees with respect to a longitudinal axis. In such an example, the normal direction at an angle or angles can be utilized to determine whether equations adequately described wear at such an angle or angles.

As an example, data acquired from pulled equipment can be utilized to perform simulations that aim to arrive at such data at a corresponding time. For example, where an operational history is recorded until a pull time, that operational history may be utilized in a simulation that can be iteratively repeated to reduce error between determined wear and actual wear via adjustment to one or more parameters of a model (e.g., a physics based model, etc.). As a model can account for normal forces (e.g., with direction azimuthally), which can result in deviations (e.g., normal to a longitudinal axis, etc.), a process can be iterative to match frictional wear to one or more components being a result of normal forces. Where materials may be abrasive and/or corrosive, a model may take one or more of those factors into account. For example, abrasive material such as sand can accelerate wear for a given time varying normal force of a component that contacts another component (e.g., due to deviation from its longitudinal axis during cyclical motion) and/or a corrosive chemical environment can accelerate wear for a given time varying normal force of a component that contacts another component (e.g., due to deviation from its longitudinal axis during cyclical motion).

As an example, a system can provide for estimation of a time where a rod guide (e.g., SRC) is worn such that metal to metal contact will occur (e.g., due to deviation from a longitudinal axis, etc.) with a normal force that is predicted to cause wear to one or both of the metal components. In such an example, a safety factor may be utilized to stop operations and pull equipment prior to occurrence of metal to metal contact. For example, consider contact with tubing where wear to tubing may occur due to metal to metal contact. As explained, pulling can help to reduce undesirable consequences, which can include wearing tubing such that tubing is to be replaced, wearing a rod or rods until failure such that a fishing job is to occur to "fish-out" the failed equipment, etc. Such undesirable consequences can themselves place equipment and/or people at risk, while also being considered non-productive time (NPT), which may cause an operation or operations to not meet one or more performance indicators (PIs).

As an example, a system can be tuned based on post-pull data to improve performance of the system and control of a pump system. In such an example, post-pull data may come from one or more installations, which may benefit one or more on-going installations. As an example, a system can be improved by pulls at one or more other installation sites while the system controls pump operation at its site.

As an example, a system can provide for improving installation design. For example, consider improving SRC number and/or placement. As an example, a number of SRCs may be increased and/or decreased and positioned to reduce wear at one or more locations.

As to types of failures, one or more of the following may be considered in a method such as the method 800 of FIG. 8:

- Polished rods
  - Not in center of tee throughout pumping cycle
  - Smaller than recommended by API
  - Top of carrier bar not horizontal
  - Crooked—not vertical—wellhead
  - Crooked hole near surface, with pony rods below the polished rod

- Corrosion
- Abrasion
- Excessive heat
- No lubrication
- Packing too tight

Pony rods (rod subs)
- Old subs used with new rod string
- Improper API-grade rod
- Sub directly below polished rod Rod couplings (boxes)
- Slimhole couplings used
- Hammered-on boxes
- Insufficient circumferential displacement
- Dirty or improperly cleaned threads
- Improper or no lubricant (should be a properly screened inhibitor, not tubing or drillpipe dope)
- End face not perpendicular to the threads
- Oxygen in system
- Couplings made from free-machining steels Rod pins
- Old-style, nonundercut pins
- Incorrect circumferential displacement
- Box and pin not made up, but broken out and remade on new C and K rods
- Box shoulder and pin shoulder not parallel Rod upsets
- Worn elevators
- Rod bent while tailing out or in
- Rods corkscrewed above the pump during normal pumping
- Rods corkscrewed after parting
- Vibrations
- Manufacturer's marks
- Running too fast in the hole Rod body
- Inadequate/ineffective corrosion inhibition
- Hydrogen embrittlement
- Overload
- Nicks
- Service time exceeds fatigue life
- Rough surface
- Yield strength exceeded while attempting to unseat pump
- Defective material
- Oxygen allowed in the pumping system
- Bends Valve rod (stationary barrel pump)
- Pump not centralized in tubing
- Improper material
- Plunger too short and pump not centralized
- Crooked hole at pump setting depth
- Pounding fluid Pull tube (traveling barrel pump)
- Pump not centralized in tubing
- Pull tube buckling on downstroke
- Improper material
- Pump set too deep for pull-tube length
- Pounding fluid As to string replacement, replacing a rod string one rod at a time may be suboptimal; thus, the economic life of a rod string can be considered if rods start to fail or, as explained with respect to FIG. 8, are expected to fail. In various practices, a rod-string section may be replaced after two or three failures, while the entire rod string may be replaced after three or four failures. As mentioned, a method can include post-pull assessments as to failure, which can be utilized in simulations to adjust one or more models and/or to design one or more pump system.

As an example, a post-pull assessment may not be able to assess a root cause as failure may not have occurred (e.g., pulling prior to failure); however, a simulation may be performed given post-pull and operational history to perform one or more simulations that indicate what would be a root cause. For example, consider running a simulation forward in time using post-pull information from an assessment until a failure is reached, which may be assessed to determine whether the reason for pulling and/or the post-pull assessment correspond to the simulated root cause of failure. Where the simulated root cause differs from an assessed likely root cause, one or more adjustments may be made to a model or models (e.g., and/or solver) and/or a post-pull assessment process such that agreement is reached as to what is the likely root cause (e.g., was simulation indicative or was assessment indicative, or a combination of both?).

Figure 9:
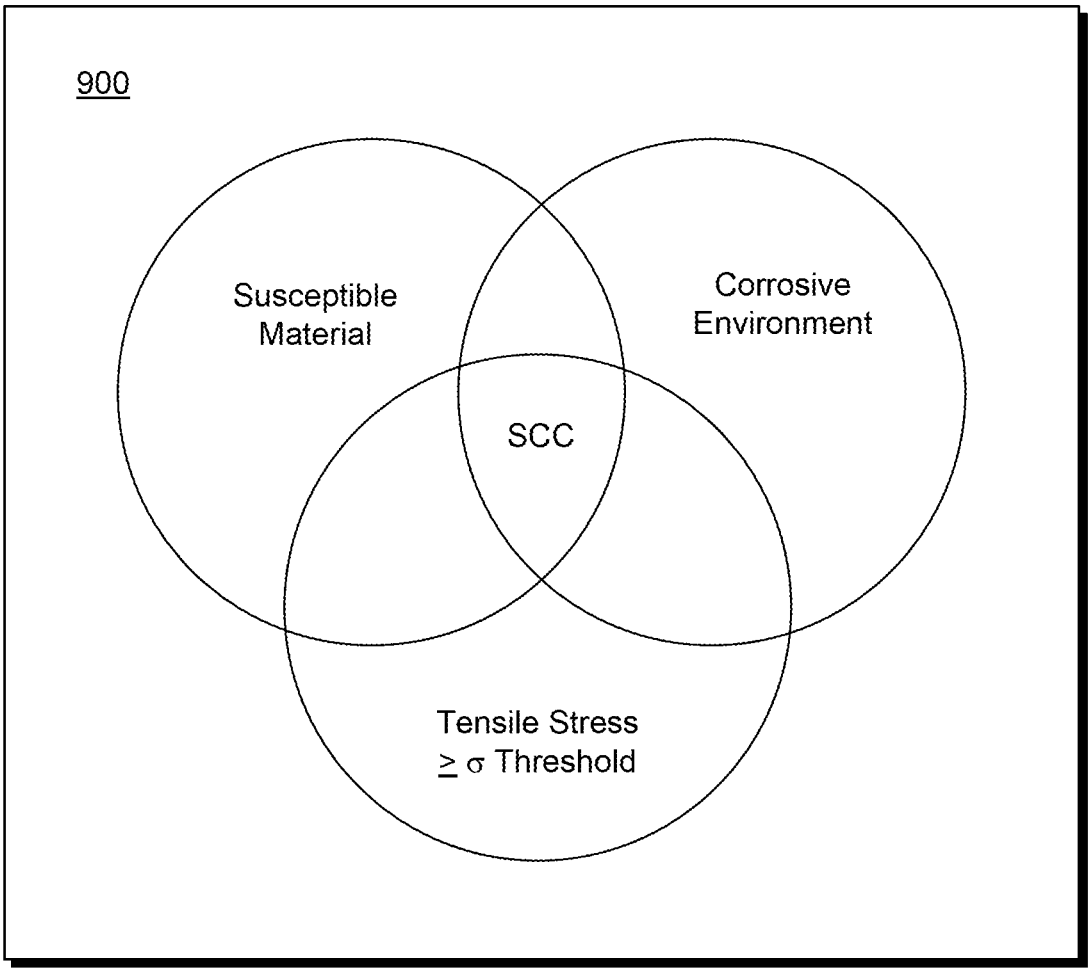
FIG. 9 illustrates an example plot of some factors associated with stress corrosion cracking (SCC)

FIG. 9 shows a diagram 900 that illustrates stress corrosion cracking (SCC), which is a type of corrosion process (e.g., a degradation process), which may exist in an environment where a pump system is implemented. As shown, SCC may occur given a susceptible material, a corrosive environment and a tensile stress that is greater than or equal to a stress threshold. In terms of temporal aspects, the three conditions represented in the Venn type of diagram 900 may occur simultaneously to promote SCC. SCC can cause a material or part to fail at a stress level below a material-rated yield strength (e.g., a frangible degradation mechanism).

SCC involves growth of crack formation in a corrosive environment and can lead to unexpected sudden failure of normally ductile metals subjected to a tensile stress, particularly at elevated temperature. SCC can be highly chemically specific in that certain alloys are likely to undergo SCC when exposed to a small number of chemical environments. The chemical environment that causes SCC for a given alloy is often one which is mildly corrosive to the metal otherwise. Hence, metal parts with severe SCC can appear bright and shiny, while being filled with microscopic cracks. SCC may progress rapidly. Stresses can be the result of the crevice loads due to stress concentration, or can be caused by the type of assembly or residual stresses from fabrication (e.g. cold working). As an example, in some instances, residual stresses can be relieved at least in part by annealing and/or one or more other types of surface treatments.

As an example, a material or alloy can be susceptible to SCC (e.g., stronger or harder the material, the more susceptible to fracture providing the environment is conducive to SCC). As an example, an environment amenable to SCC may include one or more corrosive substances (e.g., halides like chlorides, etc.) and may be of a temperature that promotes kinetics, thermodynamics and/or mechanical degradation (e.g., expansion, different thermal conductivities, etc.). As an example, the more corrosive the conditions and the more likely fracture may occur as a result of imposed tensile stresses. As to tensile stresses, the greater the tensile stresses, the sooner a fracture or fractures may develop; further, below a certain threshold, cracking may not occur unless the environment or materials are made more amenable to stress-corrosion cracking.

During installation, use and/or removal of a rod string in a bore of a well, which may be a bore of casing, a joint can come into contact with well fluid. For example, well fluid may enter a clearance between a rod and a coupling and come into contact with threads. As an example, sour gas may contact threads. In such an example, the threads may be in a sour gas environment (e.g., in an environment that includes sour gas).

Sour gas can be a term that characterizes gases that are acidic either alone or when associated with water. Two examples of sour gases associated with oil and gas drilling and production are hydrogen sulfide, $H_2S$, and carbon dioxide, $CO_2$. Sulfur oxides and nitrogen oxides, generated by oxidation of certain sulfur- or nitrogen-bearing materials, can be in such a category but tend not to be found in anaerobic subsurface conditions.

As an example, a physics-based model can include one or more terms that can account for environmental conditions, which may include one or more stress-related environmental conditions that may affect integrity of pump equipment.

Figure 10:
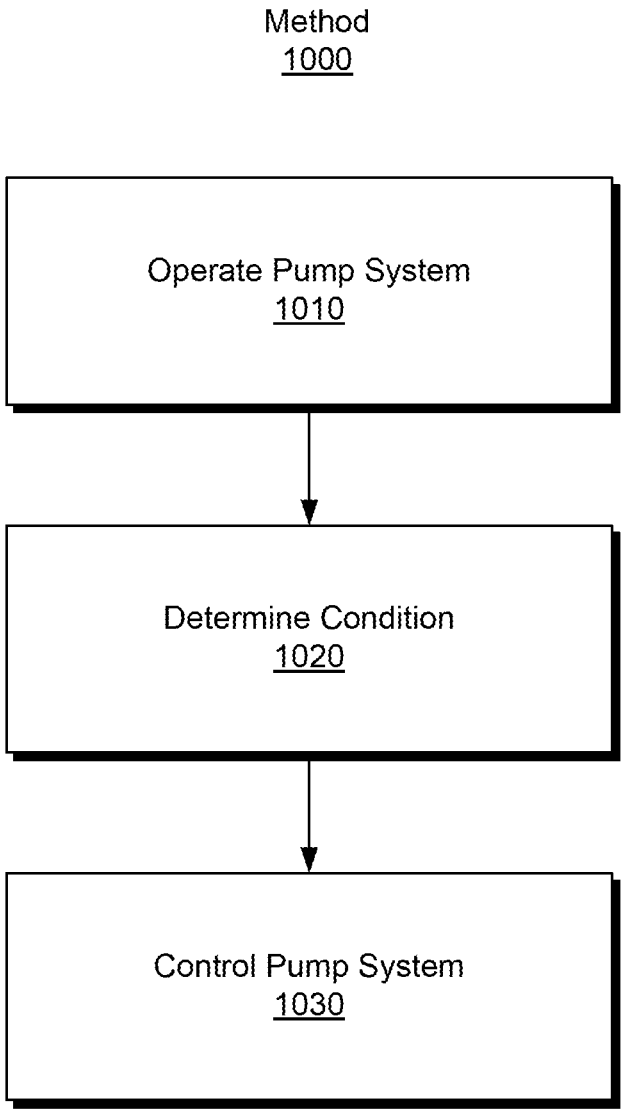
FIG. 10 illustrates an example of a method.

FIG. 10 shows an example of a method 1000 that includes an operation block 1010 for operating a pump system, a determination block 1020 for determining a condition associated with a pump system, and a control block 1030 for controlling the pump system based at least in part on the condition. As an example, the method 1000 may be implemented at least in part via a controller. As an example, the method 1000 may be implemented at least in part via a computing system, which may optionally be or include one or more controller components (e.g., interfaces, etc., operatively coupled to one or more pieces of field equipment).

Figure 11:
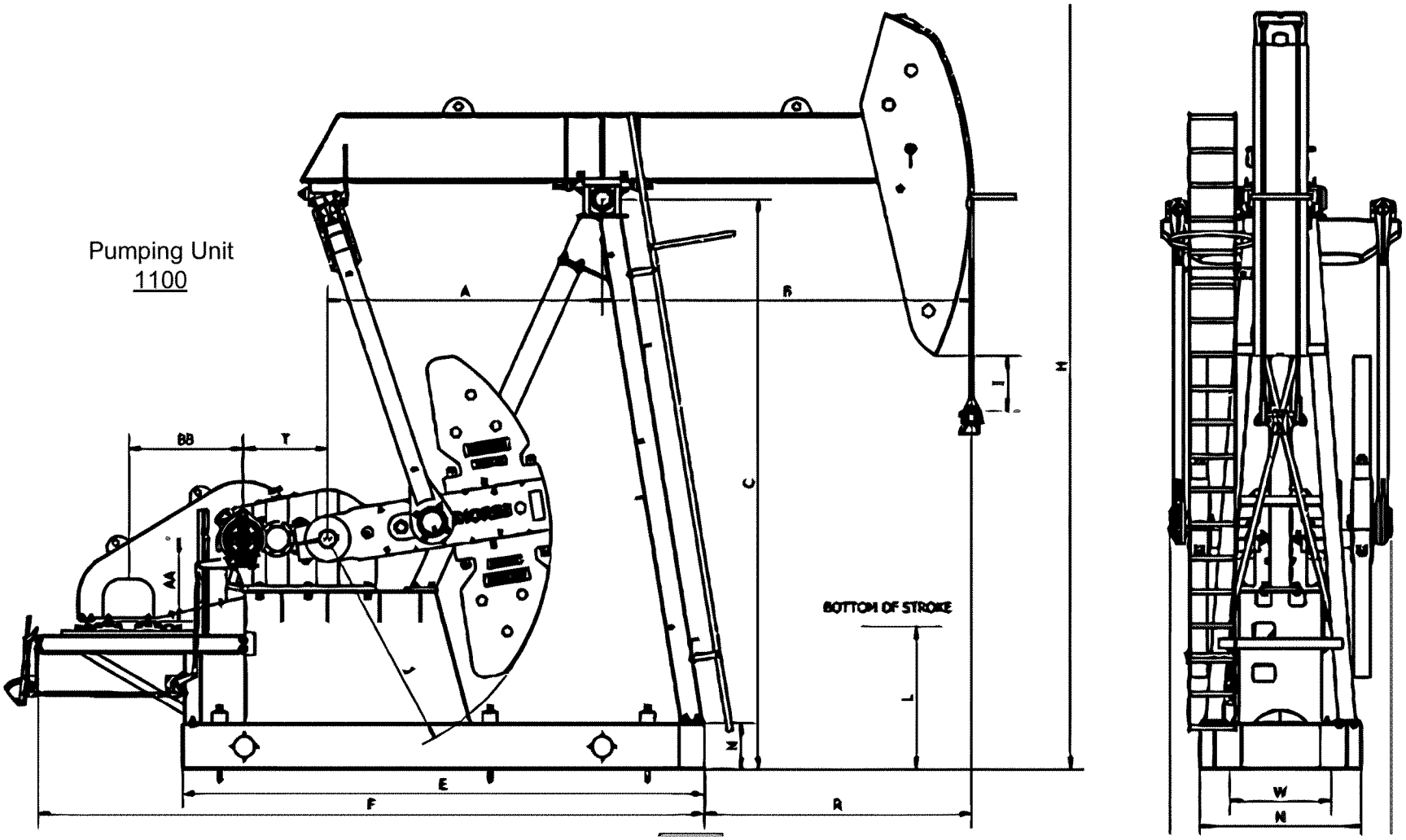
FIG. 11 illustrates an example of a pumping unit.

FIG. 11 shows an example of a pumping unit 1100, which includes various dimensions. While referred to as a "unit", as can be discerned, the pumping unit 1100 is an assembly of various components configured to operatively coupled to a rodstring for purposes of pumping fluid. The pumping unit 1100 may be referred to as an assembly or a system. A document entitled "Conventional Pumping Unit" is incorporated by reference herein (https://www.slb.com/~/media/Files/artificial_lift/product_sheets/rodlift/conventional-pumping-unit-ps.pdf), which provides various specifications with respect to the pumping unit 1100, for example, depending on model type (e.g., C80 to C1280), etc. (Schlumberger Limited, Houston, Tex., brochure/document 18-AL-405851). Such a pumping unit or other type of pumping unit can be part of a pumping system that can be considered in a method such as the method 1000 of FIG. 10. Such a pumping system can include one or more controllers that can provide for control of one or more pumping units.

As an example, a method can include operating a pump system; determining a condition associated with the pump system; and controlling the pump system based at least in part on the condition. In such an example, determining can include utilizing a physics-based model that includes two spatial dimensions and/or a physics-based model that includes three spatial dimensions. As an example, a 3D spatial model can provide for modeling buckling associated with a rodstring of a pump system. As an example, modeling can include adjusting for acceleration to improve a pump load model, for example, for estimating one or more gas characteristics using the pump load model and/or estimating stroke length using the pump load model.

As an example, a pump system can be disposed at least in part in a deviated well (e.g., a well that deviates from vertical by a particular amount, etc.). In such an example, a method can include utilizing a physics-based model that includes an axial dimension and a radial dimension as a dimension normal to the axial dimension.

As an example, a method can include determining a condition based on a force measurement where the condition can be a position. Such a position can be a position in one or more spatial dimensions, which may or may not vary with respect to time.

As an example, a pump system can include a sucker rod pump. As an example, a condition can be a pump system condition and/or a well condition. As to the latter, consider, for example, a well condition that pertains to a well angle defined with respect to a vertical direction (e.g., a deviated portion of a well, etc.). As an example, a condition can be a fluid condition.

As an example, a method can include utilizing a physics-based model to generate training data, training a machine model utilizing the training data to generate a trained machine model and where a condition is output from the trained machine model responsive to receive of an input associated with operating the pump system. As mentioned, a method can include utilizing patterns such as for pattern recognition, which may be, for example, via a trained model.

As an example, a system can include one or more processors; memory accessible to at least one of the processors; and processor-executable instructions stored in the memory and executable by at least one of the processors to instruct the system to: operate a pump system; determine a condition associated with the pump system; and control the pump system based at least in part on the condition. In such an example, the system can include at least one electrical interface that is operatively coupled or operatively coupleable to at least one pump system for control of at least one of the at least one pump system and/or for acquisition of data generated by one or more pump systems.

As an example, one or more computer-readable media can include computer-executable instructions executable to instruct a computing system to: operate a pump system; determine a condition associated with the pump system; and control the pump system based at least in part on the condition. Such one or more computer-readable media (CRM) may be utilized, for example, in a system, which may be a local system or may be a distributed system. As an example, a system can be a field system that is operatively coupled to one or more pieces of field equipment for purposes of data acquisition and/or control.

Figure 12:
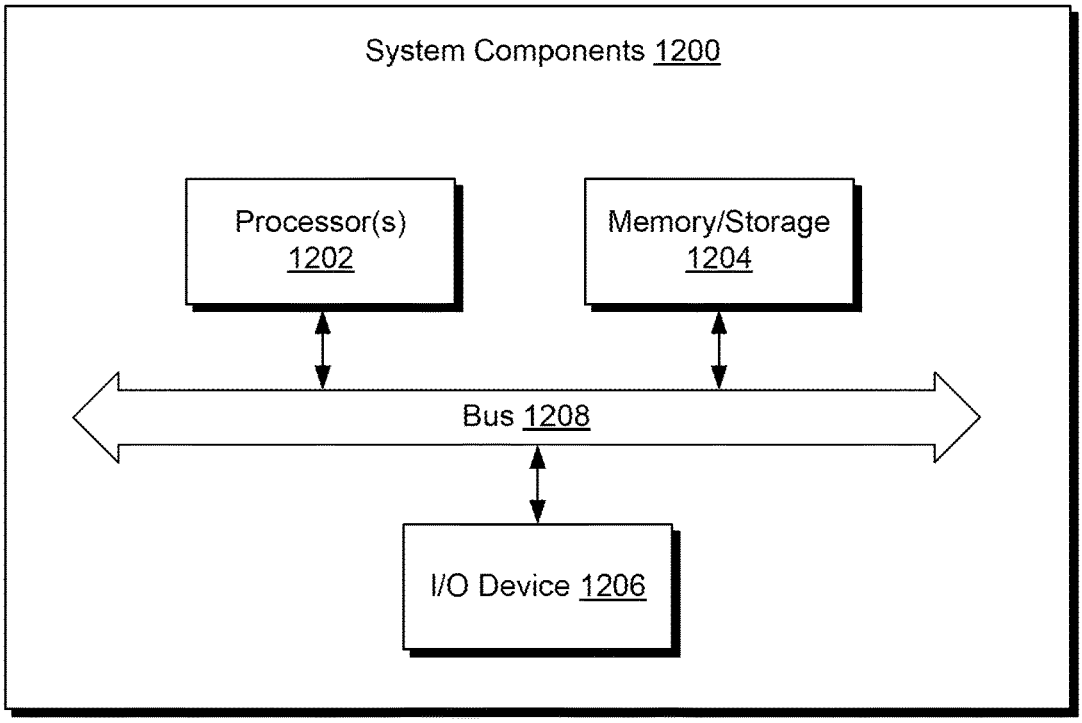
FIG. 12 illustrates an example of computing system and a networked computing system.
Figure 12:
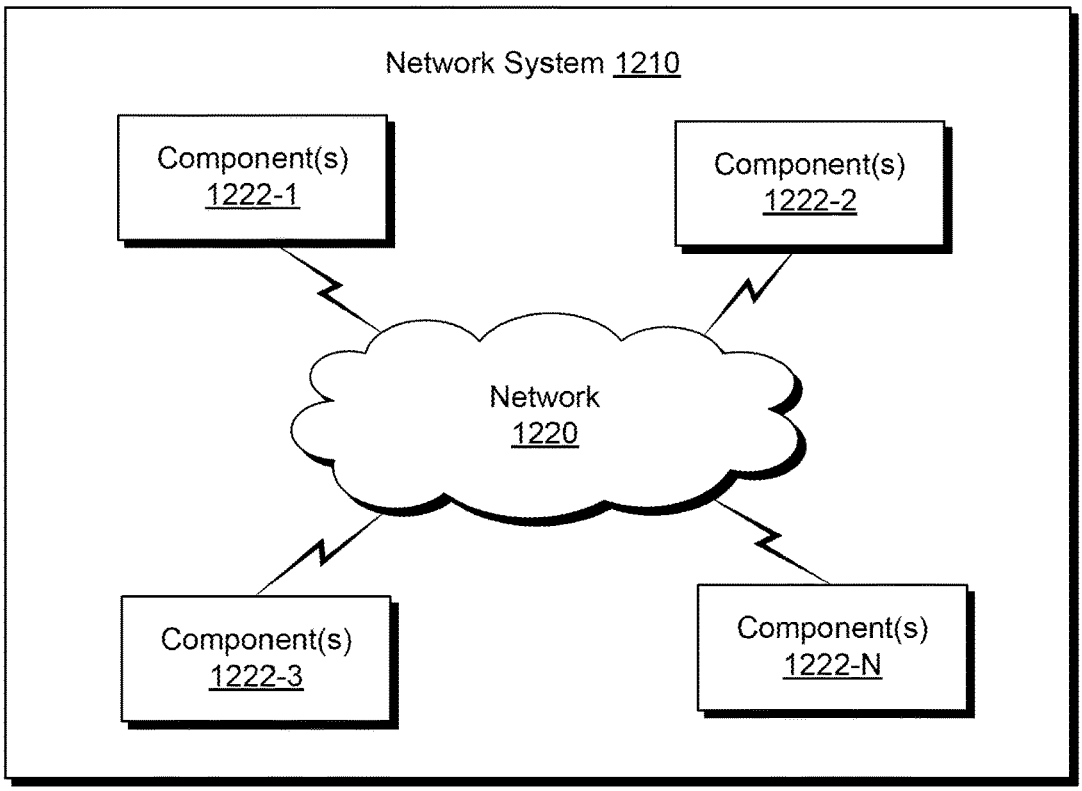

FIG. 12 shows components of a computing system 1200 and a networked system 1210. The system 1200 includes one or more processors 1202, memory and/or storage components 1204, one or more input and/or output devices 1206 and a bus 1208. According to an embodiment, instructions may be stored in one or more computer-readable media (e.g., memory/storage components 1204). Such instructions may be read by one or more processors (e.g., the processor(s) 1202) via a communication bus (e.g., the bus 1208), which may be wired or wireless. The one or more processors may execute such instructions to implement (wholly or in part) one or more attributes (e.g., as part of a method). A user may view output from and interact with a process via an I/O device (e.g., the device 1206). According to an embodiment, a computer-readable medium may be a storage component such as a physical memory storage device, for example, a chip, a chip on a package, a memory card, etc.

According to an embodiment, components may be distributed, such as in the network system 1210. The network system 1210 includes components 1222-1, 1222-2, 1222-3, . . . 1222-N. For example, the components 1222-1 may include the processor(s) 1202 while the component(s) 1222-3 may include memory accessible by the processor(s) 1202. Further, the component(s) 1222-2 may include an I/O device for display and optionally interaction with a method.

The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising: operating a pump system, the pump system comprising a rod; utilizing a wave propagation model to estimate a first present downhole condition of the pump system based on a present surface condition of the pump system, wherein the wave propagation model is implemented in the form $$vx(xi,t)=vx(xi,ti-1)+(dt/dm)*Ftot_x(xi,t-1)/fc;$$

$$vz(xi,t)=vz(xi,t-1)+(dt/dm)*Ftot_z(xi,t-1)/fc$$

$$\text{omega}(xi,t)=\text{omega}(xi,t-1)+(dt/dI)*Mtot_y(xi,t-1)$$

vx: velocity in horizontal direction in global coordinate system vz: velocity in vertical direction in global coordinate system omega: angle velocity describing the bending in each defined segment t: discretized time xi: discretized position dt: time increment dm: mass per segment dI: bending moment Ftot_x: sum of internal and external forces in horizontal direction (spring force, bending force, solid friction)

Ftot_z: sum of internal and external forces in horizontal direction (spring force, bending force, solid friction, gravity)

Mtot_y: bending moment wherein the solution returns a two-dimensional displacement of a rod of the pump system and time, the two-dimensional displacement comprising vertical and horizontal displacement; and or, wherein the wave propagation model is further implemented in the form $$vy(yi,t)=vy(xi,ti-1)+(dt/dm)*Ftot_x(yi,t-1)/fc;$$

$$\text{omega_}x(yi,t)=\text{omega}(yi,t-1)+(dt/dI)*Mtot_x(yi,t-1)$$

$$\text{omega_phi}(xi,t)=\text{omega_phi}(\text{Phi_}i,t-1)\leftarrow(dt/dJ)*Mtorsiona_z(\text{Phi_}i,t-1)$$

Fc: damping adjustment factor

Mtorsiona_z: torsion term wherein the solution returns a three-dimensional displacement of a rod of the pump system, the three-dimensional displacement comprising vertical displacement, horizontal displacement, and helical buckling; utilizing a machine model to estimate a second present downhole condition of the pump system based on the present surface condition of the pump system; generating training data, wherein the training data is based on a comparison of the first present downhole condition and the second present downhole condition; training the machine model utilizing the training data to generate a trained machine model, wherein the trained machine model predicts a future downhole condition associated with the present surface condition of the pump system, wherein the future downhole condition relates to one or more of rod wear, rod guide wear, and tubing wear; and controlling the pump system based at least in part on the future downhole condition predicted by the trained machine model, such that one or more of rod wear, rod guide wear and tubing wear is reduced.

2. The method of claim 1, wherein the wave propagation model includes two spatial dimensions.

3. The method of claim 1, wherein the wave propagation model includes three spatial dimensions.

4. The method of claim 1, wherein the wave propagation model comprises a first pump load model and the machine model comprises a second pump load model, wherein the first downhole condition comprises acceleration of the rod estimated by the first pump load model and the second downhole condition comprise acceleration of the rod estimated by the second pump load model.

5. The method of claim 4, wherein the first downhole condition further comprises one or more gas characteristics estimated by the first pump load model and/or a stroke length of the rod estimated by the first pump load model, wherein the second downhole condition further comprises one or more gas characteristics estimated by the first pump load model and/or a stroke length of the rod estimated by the second pump load model.

6. The method of claim 1, wherein the pump system is disposed at least in part in a deviated well.

7. The method of claim 6, wherein the wave propagation model is based on an axial dimension and a radial dimension as a dimension normal to the axial dimension.

8. The method of claim 1, wherein the present surface condition comprises a force measurement and a position of the rod.

9. The method of claim 1, wherein the pump system comprises a sucker rod pump.

10. The method of claim 1, wherein the first and second present downhole conditions each comprise a well angle defined with respect to a vertical direction.

11. The method of claim 1, wherein the first and second present downhole conditions each comprise a fluid condition.

12. The method of claim 1, wherein controlling the pump system based at least in part on the future downhole condition predicted by the trained machine model reduces the impact of noise.

13. The method of claim 1, wherein the wave propagation model is implemented in the form $$\frac{\partial^2 u(s,t)}{\partial t^2} = v^2 \frac{\partial^2 u(s,t)}{\partial s^2} - c\frac{\partial u(s,t)}{\partial t}$$

wherein the solution returns a one-dimensional vertical displacement of a rod of the pump system and time.

* * * * *